United States Patent [19]

Musillo

[11] Patent Number: 4,982,510

[45] Date of Patent: Jan. 8, 1991

[54] GOLF TEE GAUGE

[76] Inventor: Robert G. Musillo, 5481 Wolf Dr., Pittsburgh, Pa. 15236

[21] Appl. No.: 102,002

[22] Filed: Sep. 28, 1987

[51] Int. Cl.[5] ..... A63B 57/00

[52] U.S. Cl. ..... 33/833; 273/325

[58] Field of Search ..... 33/501, 508, 169 B, 33/169 R, 170, 833; 273/33, 202, 32.5, 203

[56] References Cited

U.S. PATENT DOCUMENTS

| | | | |
|---|---|---|---|
| 2,801,852 | 8/1957 | Hottle | 273/32.5 |
| 2,950,110 | 8/1960 | Slotto et al. | 33/170 X |
| 3,074,719 | 7/1963 | McKee | 273/32.5 |
| 3,540,727 | 11/1970 | Hoe | 273/33 |
| 3,671,037 | 6/1972 | Murdock | 273/32.5 |
| 4,660,837 | 4/1987 | Bressie | 273/32.5 |

*Primary Examiner*—Harry N. Haroian

*Attorney, Agent, or Firm*—William J. Ruano

[57] ABSTRACT

A golf tee gauge is in the form of a pad having a plurality of depressions into which the head protion of a golf tee may be selectively inserted to obtain selective lengths of penetration of the golf tee stem into the ground. The depressions may be aligned parallel to the edge of the pad or may extend along the perimeter thereof. Modifications of the pad include pairs of ratchets engageable with a slidable gauge element.

1 Claim, 2 Drawing Sheets

Fig.1
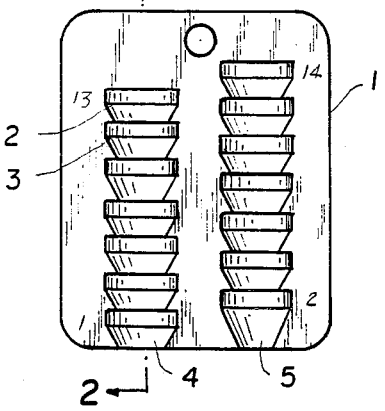
Fig.4
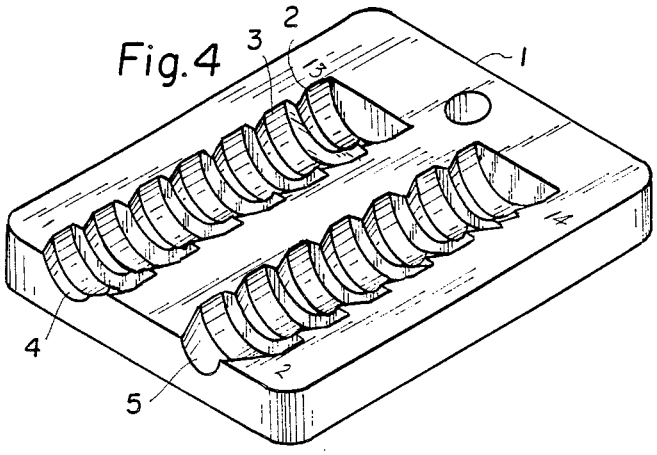
Fig.2
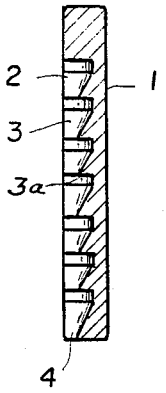
Fig.3
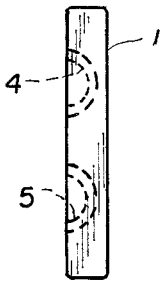
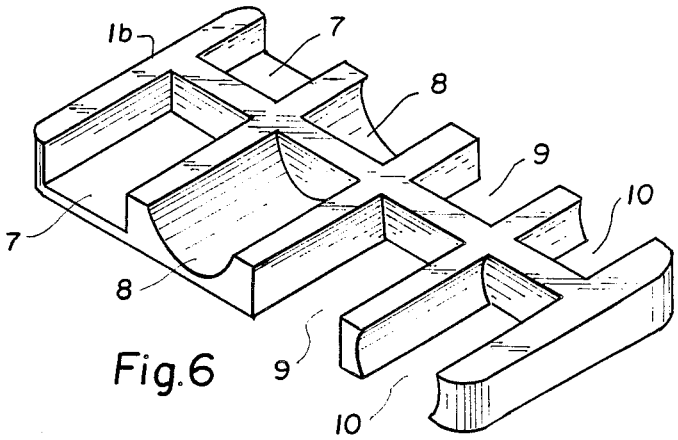
Fig.6
Fig.5
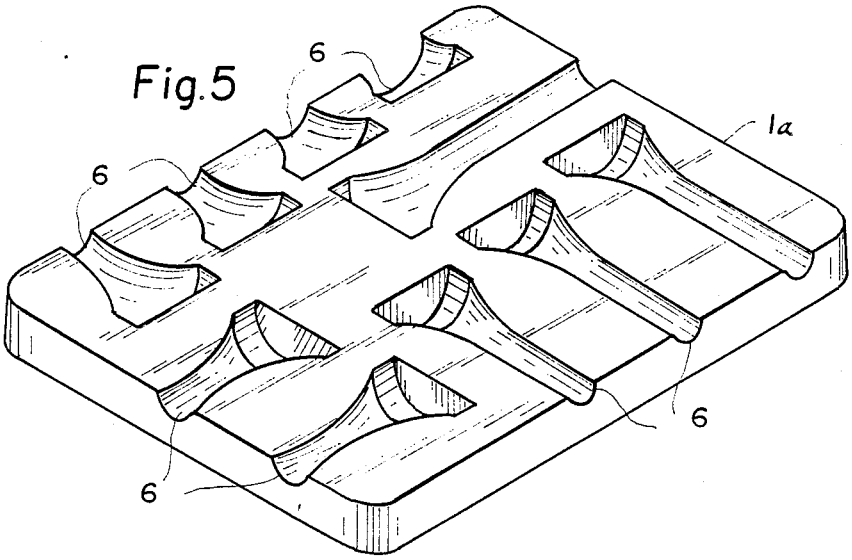

GOLF TEE GAUGE

This invention relates to a golf tee gauge.

BACKGROUND OF THE INVENTION

In the play of golf, a player manually pushes a golf tee in the ground or tee at varying distances between the top of the tee and the surface of the ground or tee. Therefore, the golfer in making the same swing, will strike the golf ball differently, introducing errors in his drive.

SUMMARY OF THE INVENTION

An object of the present invention is to overcome the above-named disadvantage by providing a golf tee gauge that will insure a constant distance between the top of the golf tee and the surface of the ground or tee. The gauge can take many forms, particularly to enable selective depths for piercing the golf tee.

BRIEF DESCRIPTION OF THE DRAWINGS

FIG. 1 is a plan view of a golf tee gauge providing selective pockets for receiving a golf tee for piercing it to selective depths from the top of the tee to the ground surface;

FIG. 2 is a vertical cross-section taken along line 2—2 of FIG. 1;

FIG. 3 is a end view of FIG. 1;

FIG. 4 is a plan view thereof;

FIG. 5 is a perspective view of a modification;

FIG. 6 is a perspective view of a further modification;

FIG. 4 is a perspective view of FIGS. 1, 2 and 3.

FIG. 5 shows a modification of the pad 1*a* which is provided with a plurality of wells or pockets, such as 6, each shaped to include the head portion of the tee but different lengths of the shank portion thereof so that by inserting the golf tee in the desired pocket portion, different lengths of penetration are obtained as the edge of pad 1*a* contacts the ground or tee surface.

FIG. 6 is a perspective view of a pad 1*b* having pockets 7, 8, 9 and 10 of different shapes to receive correspondingly shaped depth measuring elements including golf tees.

FIG. 7 shows a further modification comprising a pad or block 11 having a longitudinal groove 18 and groove ledge portion 16 for receiving a slidable springy element 13 having a base 19 which is slidable in the ledge 16 and an integral springy element 20. One end of element 20 is normally spring to the position shown in FIG. 8 away from the base 19 of element 20 so that by depressing the knob 17 and sliding element 13 to the desired depth number, then by releasing the knob, the edge portion of element 20 contacts one of the pairs of ratchets 12 formed on the underside of the edge portions 15 to allow selective engagement of the ratchets to obtain the desired depth of penetration of the golf tee that is inserted in groove 18.

FIGS. 9 and 10 show a somewhat similar structure 21 comprising a block 22 having a groove 27, ledge portions 26, and confronting ratchets 24 on the sides of the edge portions 21 and 22. In this instance, the ratchets 24 face horizontally inwardly instead of downwardly as in FIG. 7.

Figure 7:
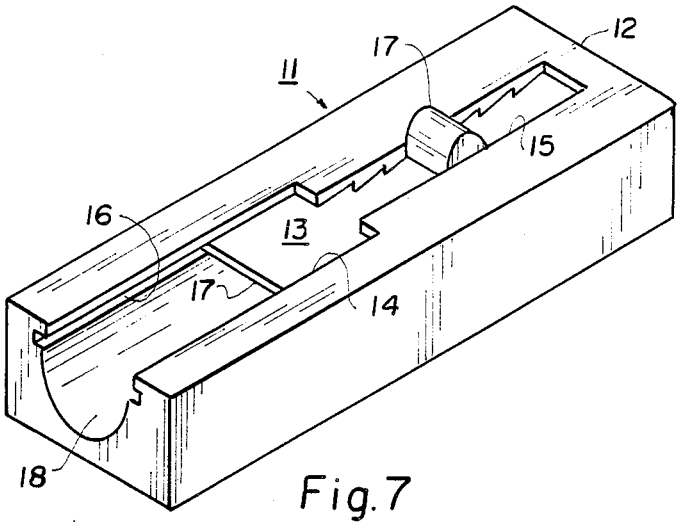
FIG. 7 is a perspective view of a still further modification.
Figure 8:
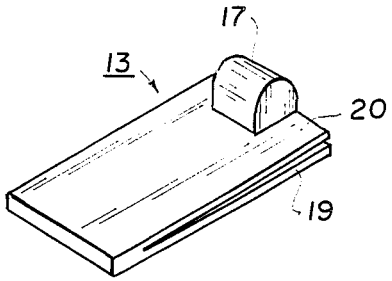
FIG. 8 is a perspective view of the slidable insert shown in FIG. 7.
Figure 9:
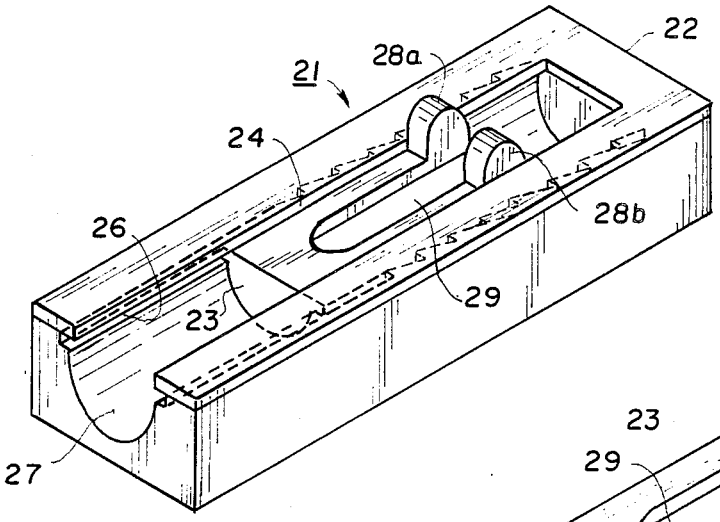
FIG. 9 is a perspective view of a modification similar to FIG. 7.
Figure 10:
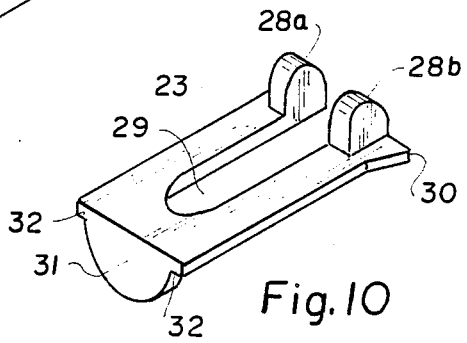
FIG. 10 is a perspective view of the adjustable insert shown in FIG. 9. Referring more particularly to FIGS. 1, 2 and 3 of the drawings, numeral 1 denotes a flat, substantially rectangular pad made of plastic or any other suitable material, such as wood or metal. A plurality of wells or pockets such as 2, 3, etc. are provided, each for receiving the head portion of a tee. As noted in FIG. 2 the downwardly and inwardly curved head portion forms a ledge 3*a* which serves as a stop to prevent vertically upward movement of the golf tee as it is being pushed towards the ground. In short, the ledge 3*a* or other ledge is the stop portion in the groove or pocket.

A modified slidable element 23 (FIG. 10) which is a substitute for element 13 shown in FIG. 8 is provided having springy end portions 23 which can be pressed inwardly by grasping projections 28*a*, 28*b* and pressing them towards each other until the selected notches 24 are reached. Upon release of the projections 28*a*, 28*b* the springy end portions, ends 30 will engage the selected ratchet pair.

Thus it will be seen that I have provided a novel golf tee gauge having selective notches, depressions or well portions into which the golf tee may be placed to predetermine the extent of penetration of the shank portions into the ground so as to obtain exactly the same height of the head portion every time to enable the golfer to have a standardized swing without errors otherwise caused from variations of the extent of penetration of the golf tee into the ground or tee.

While I have illustrated and described several embodiments of my invention, it will be understood that these are by way of illustration only and that various changes and modifications may be contemplated in my invention and within the scope of the following claims:

I claim:

1. A one piece, flat, relatively thin, substantially rectangular golf tee gauge having, on one flat surface, two parallel vertical rows of depressions, each corresponding to the shape of the head portion of a golf tee, so that upon manually holding the golf tee against a selected depression, the golf tee may be pierced into the ground to a selected depth beyond the lower edge of the gauge, the depressions in one row being staggered in relationship to those of the other to enable smaller increments of depth of penetration by moving the golf tee from one row to another.

* * * * *